United States Patent [19]

Manusch et al.

[11] Patent Number: 4,853,074

[45] Date of Patent: Aug. 1, 1989

[54] DEVICE FOR TRANSFERRING A FILM FROM A CARRIER TAPE

[75] Inventors: Christoph Manusch, Hanover; Hans-Jürgen Harp, Hemmingen, both of Fed. Rep. of Germany; Roy van Swieten, S'Herpoegenbosch, Netherlands

[73] Assignee: PELIKAN Aktiengesellschaft, Hanover, Fed. Rep. of Germany

[21] Appl. No.: 181,779

[22] Filed: Apr. 15, 1988

[30] Foreign Application Priority Data

Oct. 27, 1987 [DE] Fed. Rep. of Germany ..... 3736367

[51] Int. Cl.[4] ..... B32B 35/00

[52] U.S. Cl. ..... 156/577; 156/579; 156/584

[58] Field of Search ..... 156/577, 579, 584, 523, 156/527, 540

[56] References Cited

U.S. PATENT DOCUMENTS

| | | | |
|---|---|---|---|
| 3,955,711 | 5/1976 | Scitröter et al. | 156/577 |
| 4,096,022 | 6/1978 | Crawford | 156/577 |
| 4,574,030 | 3/1986 | Pilcher | 156/540 |
| 4,576,311 | 4/1986 | Horton et al. | 156/584 |
| 4,704,185 | 11/1987 | Fischer | 156/579 |
| 4,718,971 | 1/1988 | Summers | 156/577 |

FOREIGN PATENT DOCUMENTS

| | | | |
|---|---|---|---|
| 1911615 | 10/1969 | Fed. Rep. of Germany . | |
| 7711779 | 5/1979 | Netherlands | 156/579 |

*Primary Examiner*—Michael Wityshyn
*Attorney, Agent, or Firm*—Herbert Dubno

[57] ABSTRACT

The device, suitable for use in a hand roller, for transferring a film from a carrier tape to a substrate is a cartridge containing a feed reel and a windup reel. The tape travels by way of a protruding stiff applicator bar which has a pressure-applying edge for pressing the tape against the substrate. The stiff applicator bar is on a spring support member which can be deflected until a protrusion on the bar encounters a detent fixed on the housing. The application bar has its pressure-applying edge appropriately shaped to facilitate the transfer action.

20 Claims, 4 Drawing Sheets

DEVICE FOR TRANSFERRING A FILM FROM A CARRIER TAPE

CROSS REFERENCE TO RELATED APPLICATION

This application is related to the commonly owned concurrently filed copending application Ser. No. 07/181,940, (based upon German application No. P 37 36 357.3 filed Oct. 27, 1987).

FIELD OF THE INVENTION

Our present invention relates to a device for transferring a film, such as an adhesive film, from a carrier tape to a substrate, such as paper, and more particularly to an adhesive strip applicator.

BACKGROUND OF THE INVENTION

Devices for transferring a film from a carrier tape to a substrate are often used in offices, for instance, to transfer an adhesive film or tape from a carrier tape onto paper for purposes of adhering a piece of paper to a certain place on another piece or for binding one page to another. It is common to use a hand roller for such purposes. In this manner, the user can accomplish a clean, rapid and well-localized placement of an adhesive layer. Such hand rollers, when not being used, tend to quickly collect dust and they also have problems caused by the drying of the adhesive onto the roller.

In certain known apparatus of the hand roller type, there are a windup reel (take-up reel or spent tape reel) and a feed reel built into the housing. The pressure-applying element of these devices is generally a lever which protrudes from the housing, which is swivelable within the housing and biased by a spring away from a starting position. This lever generally has on its end protruding from the housing a rather large transverse pivot on which a plastic sleeve is rotatably mounted, over which the tape coming from the feed reel is fed and thence led back into the housing to be wound up on the windup reel.

The windup reel, in such an arrangement, is generally driven by a friction wheel (clutch) by way of a gear wheel drive.

The applicator element, in the form of a lever protruding from the housing, extends within the housing past its pivot point to the other side of the housing where it engages there by way of a detent element with the teeth of a toothed gear wheel on the feed reel, so that the rotation of the feed reel is prevented when the hand roller is in the starting position (resting position).

The large transverse pivot at the end of the applicator element extends sideways beyond the applicator element lever so that if the lever is pressed against its pretensioning spring, in the direction toward the housing (i.e. upwards), the spring can yield until the extended parts of the transverse pivot hit the housing.

This known arrangement has, however, the disadvantage that the pressure-applying radius at the end of the application element is very large, so that in practical use, there is only a poorly defined detachment line of the film being applied to the substrate (such as the paper); moreover, by the use of this apparatus, it is very difficult for the user to ascertain exactly up to what point on the substrate the adhesive film has actually been applied. Moreover, the variable position of the lever which serves both as the application element and simultaneously as an arrest arm for the feed reel, results in a disadvantage, namely that the release of the feed reel is only accomplished by a rather large movement of the device, so that a relatively unskilled person could very likely have difficulties in guiding the device to perform its function.

If such a roller is held at a somewhat tilted angle, even a small tilt cannot be compensated for and the desired application of the film to the substrate can fail or be incomplete.

OBJECTS OF THE INVENTION

It is an object of the invention to provide an improvement in a device or apparatus of the above described general type, such that it can be used manually without difficulty by even an unskilled person.

It is a further object to make available such a device which is simple and inexpensive to construct.

Still a further object is to make available such a device that affords a better defined line of separation of the film applied to the substrate. Other objects will be described hereinafter.

SUMMARY OF THE INVENTION

The above and other objects are achieved with a device for the transfer of a film from a carrier tape to a substrate, which comprises a housing, which contains, mounted rotatably in the same plane, a feed reel for the tape and a windup reel for the tape from which the transfer has been effected. The housing also has a support member for an stiff applicator bar, the other end of this bar protruding from the housing and over which the tape passes in going from the feed reel to the windup reel. This stiff applicator bar is configured so as to press the tape against the substrate (with the side of the tape carrying the film being against the substrate) so as to effect the transfer of the film.

It is a feature of the invention that the stiff applicator bar is deflectable by virtue of the elastically bendable support member as pressure is exerted downward on the device.

It is a further feature of the invention that the housing is provided with fixed detent means for limiting the deflection of the stiff applicator bar. It is a further feature of the invention that the stiff applicator bar has on its side facing the carrier tape a rounded pressure-applying edge, and also there is a protrusion on the stiff applicator bar, located at a distance from the pressure-applying edge, and arranged so as to impact the detent fixed on the housing when the stiff applicator bar is pushed to its limiting deflection, so as to limit the movement of the stiff applicator bar.

The device of the invention, in contrast to the prior art apparatus, does not have a massive stiff applicator element, but rather a small and flexible element (comprising the stiff applicator bar and its flexible support), which under applied pressure from the user, undergoes an elastic deflection as a result of its own elasticity, and consequently needs neither a special additional pretensioning spring within the housing to restore it to its starting position, nor a rotatable pivot within the housing; rather, the applicator element in accordance with the present invention needs only a fixed point of attachment within the housing.

Also in accordance with the invention, the application bar at the end of the support member member is a stiff part in contrast to the springlike support member, and is substantially smaller and less demanding of material than the cylindrical pivot of the prior art apparatus, moreover, it offers the possibility for the use of its edge as a rounded pressure-applying edge to press the carrier tape along with its film against the substrate; by virtue of a much smaller bending radius, the result is that the separation edge of the transferred film is much better defined for the user.

Since the limiting detent for the spring deflection of the stiff applicator bar needs only be at the end of the support member and thus can be quite small in its dimensions, the extent of displacement of the detent from the pressure-applying edge can be quite small also, and thus the lever arm by means of which pressure applied by the user is transmitted via the stiff applicator bar to the pressure-applying edge, can be quite small as well. This has the result that even very heavy pressure by the user on the pressure-applying edge will be transmitted adequately.

The device of the invention can be used for applications other than those described above, for instance, for many applications in which large pressures must be applied to small pressure-bearing radii. Thus, the apparatus of the invention can be used with carrier tapes which have on them a cover film (correction film), in order to apply corrections to typing in a typewriter or printer. In this case, because of the depressions on the paper corresponding to the dimensions of the letters which are caused by the impact of the type of the typewriter on the paper, it is important that a high enough pressure be exerted on the cover layer to make certain that the cover layer is securely attached in these depressions. For such applications, the prior art apparatus is in general not applicable, on account of the large radius of the cylindrical pivot at the end of the applicator bar, and also on account of the impossibility of producing the very high local pressure for pressing the film from the carrier tape at the needed locations.

The apparatus of the invention permits the entire application element to be made quite small, and also the attachment of the application element to a fixed base on the housing and the avoidance of the need for a pretensioning spring with the final result that, along with the requisite driving means and frictional coupling between the feed reel and the windup reel, the entire assemblage is not only simpler but also requires substantially less material for its construction. The overall result is that the total apparatus can be built smaller and more neatly than the apparatus previously known.

In order to have, in the apparatus of the invention, the requisite rigidity of the application bar, where rigidity and stiffness are required, namely in the end region, but at the same time to be able to have the application element compact and elastic, an especially favorable means is to have the application bar substantially thicker than than its support, at least 1.25 times thicker, and to have the length of the application bar about one-quarter to one-third the length of its support. With this arrangement, the use of material, relative to functionality, is practically at an optimum.

The application bar and its support member can obviously consist of the same material and be formed as a single piece. However, it is especially advantageous for them to be made of different materials, so that the material of each can be optimized for its function.

A further advantageous embodiment of the invention consists in having the stiff applicator bar replaceable, so that the user can change the stiff applicator bar to select the optimum bar for each use and each substrate material. In this regard, it is important that the application bar be placed firmly enough on the support member and in the right direction so that the tape does not cause it to pull loose.

It is particularly preferred that the application bar be placed on its support member by sufficient friction such that even if the carrier tape should come off, there is no likelihood of the stiff applicator bar slipping off.

For the rounding of the pressure-applying edge of the applicator bar, various contours can be used, depending on the requirements of the film to be transferred; for example, a smaller radius is used to produce higher pressure in the application region.

It is preferred for the pressure-applying edge of the applicator bar to have a semicircular shape, preferably with a radius not greater than 1.5 mm. Another, very advantageous shape of the contour consists of having a diminishing radius, viewed in the direction of motion of the tape, so that with advancement of the carrier tape against the stiff applicator bar an increasingly strong bending of the tape occurs; in this instance, the smallest radius used should be no greater than 1.5 mm.

With this variant of the applicator surface, there is achieved an improved gripping of the edge of the adhesive left from its last usage. This result is also even more favored by having on the end of the stiff applicator bar next to the pressure-applying edge a "heel", a rounded protruding edge parallel to the pressure-applying edge and separated from it by an indentation. The "heel" has a substantially smaller radius than that of the pessure-applying edge. The common tangent to both the heel and the pressure-applying edge must make an angle of from 35° to 45°, preferably 40°, with respect to the long axis of the stiff applicator bar.

This arrangement gives an especially favorable possibility for having the adhesive get a good immediate grip on the substrate. This arrangement is especially useful in case the detachment edge should happen not to be directly under the pressure-applying edge; in this case, the user, having seen that upon the first application and the initial motion of the hand roller the transfer has failed to take place, can bring about a second attachment point just behind the pressure-applying edge, by a small lowering of the angle over the heel. At this second application point, the transfer of the film reliably takes place, thus overcoming the initial failure to attach.

It is further preferred in the present invention that the protrusion in the middle of the stiff applicator bar be humplike, and it is especially preferred that it be integrated with the bar as one piece. It has been found particularly advantageous for the protrusion to be on the opposite end of the bar away from the region of the carrier tape, and especially if the length of the stiff applicator bar is relatively short.

It is advantageous furthermore, for the protrusion to have a cross section, viewed across and perpendicular to the long direction of the stiff applicator bar, which has upwardly converging side walls and a rounded peak, i.e., "hump-shaped".

It is especially preferred if the front surface of the protrusion, closest to the pressure-applying edge of the stiff applicator bar, also is inclined upward. In this way, it is made possible that the upper region of the protrusion which impacts with the detent, should be rounded, for example hemispherically, and should have a small area, so that if the user slants the apparatus, the elastic restoring forces of the support member will compensate, thus achieving an uninterrupted transmission of the manually applied pressure as well as uniform seating of the pressure-applying edge against the substrate.

It is highly preferred in this connection to have the upper face of the protrusion, which contacts the detent, shaped as a cylindrical or spherical section.

An advantageous embodiment of the present invention consists of having the contact surface of the detent shaped to correspond to the shape of the surface of the protrusion.

This affords especially good results if the surface of the protrusion which contacts the detent is not flat but rather cylindrical or spherically shaped as mentioned above.

In this way, an optimal mutual supporting contact of the two surfaces is achieved on account of the maximization of the support member surface (and therewith the minimization of the application pressure exerted thereon to be transmitted).

The formation of the support, in the apparatus of the invention, can be done in any suitable way which assures that under use conditions the desired elastic deflection is produced when the stiff applicator bar is pushed in the correct direction relative to the substrate.

However, a highly preferred construction of the support member consists in having it shaped as a lever with a knee, with this knee directed toward the tape between the feed reel and the stiff applicator bar, and where it is also preferred that the pressure-applying edge, the point of attachment of the support, and the rotational axis of the feed reel all lie in a line, in a plane perpendicular to the pressure-applying edge and running through the point of attachment of the support. This has the advantage that upon insertion of the reel, the working line lies along this line and makes possible a good spontaneous return to the rest position when the pressure is released.

An especially preferred embodiment of the apparatus of the invention is one in which the support, the stiff applicator bar, and the protrusion as well as the detent are all made of plastic. The choice of material can differ, however, depending on the application requirements.

Thus, for some applications, it is advantageous to have the support member made of spring metal strip, on which it is advantageous to mount an stiff applicator bar made of plastic. This is advantageous if larger application forces must be borne (as in the case of cover film) or if for special reasons a stronger loading of the support, an especially long lifetime thereof, or especially strong elastic restoring forces even at small inclinations are desired.

The apparatus in accordance with the invention is suitable, as has already been shown, for use as a hand roller of the type already mentioned. Another, highly advantageous embodiment of the apparatus of the invention is that, instead of having it directly built into a hand roller, it instead is put into a holder which encompasses the application elements, the feed reel and the windup reel, and this holder is in the form of a replaceable cartridge which fits into the housing of a hand tool. This form has the great advantage that the change of the reel in the hand tool can be done very quickly without the necessity of fitting in the feed reel and windup reel or threading the tape; the used cartridge need only be taken out and a new one put in.

The hand tool must have a corresponding opening at the place where the application element protrudes diagonally from the cartridge, corresponding to the application element of the hand roller, so that upon putting in the new cartridge and closing the housing, the tool is ready for use.

In this embodiment, a drive linkage is provided between the feed reel and the windup reel as well as the friction coupling, which still must be provided for within the housing of the hand roller (but not in the replaceable cartridge), so that upon loading the replaceable cartridge, only one corresponding coupling of the reel in the cartridge must be accomplished, and can be done by means of a coupling axle of the drive in the housing meshing with the reel in the cartridge by way of a corresponding opening. This arrangement is similar to that used for the replaceable color ribbon cartridges in a typewriter.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
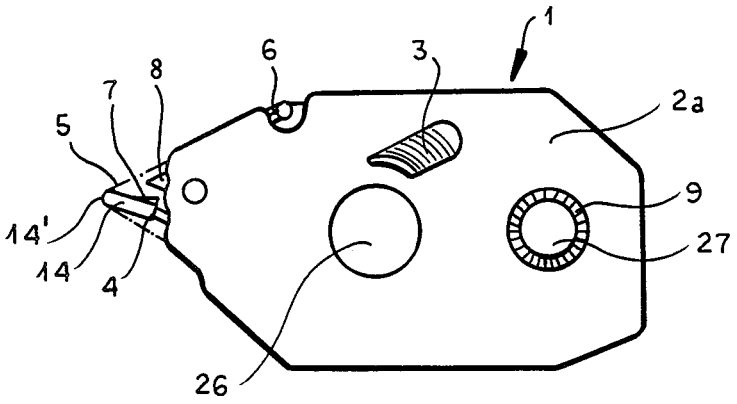
FIG. 1 is a device in accordance with the invention shown in the form of a changeable cartridge ready to be inserted.
Figure 2:
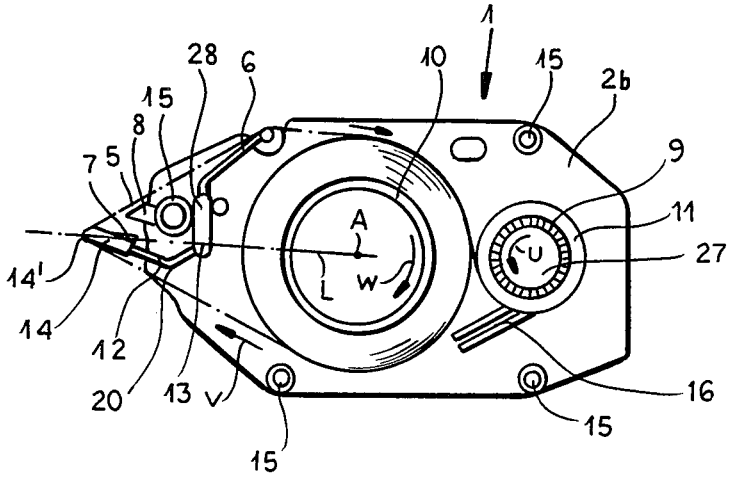
FIG. 2 is a cartridge in accordance with FIG. 1 but depicted open with one of its side covers removed.

In FIG. 1 and 2, a replaceable cartridge is shown which fits into the housing of a suitably constructed hand roller (not shown in the figures).

The cartridge 1 has two side covers 2*a* and 2*b* of which the representation in FIG. 1 only shows the side cover 2*a* turned toward the observer, while FIG. 2 shows the cartridge of FIG. 1 but with the side cover 2*a* removed, so that in the latter FIGURE the side cover 2*b* is visible.

As the opened depiction of the cartridge 1 in FIG. 2 shows, there is first of all a supply reel (feed reel) 10, on which the carrier tape 5 is initially wound, this tape being covered on its outer side with a suitable film 5*a* (see depiction of this in FIG. 3), which in the form of a suitable adhesive film or in the form of a cover layer is delivered onto, for instance, a sheet of paper.

The thus-covered carrier tape 5 unwinds from the feed reel and runs therefrom in the direction of the front end of the cartridge (leftwards as shown in FIG. 1 and 2), to a applicator element 4 which protrudes out of the cartridge (see FIG. 1). This applicator element 4 consists of a support member lever 12 which is held firmly and unrotatably, i.e. solidly clamped in, to a base 13, this lever being formed as a bent lever of which the sharply bent position 20 faces in the direction of the carrier tape section which is between the supply reel 10 and the applicator element 4.

On the other end of the support member lever 12 there is a stiff applicator bar 14 on which is formed, at the free forward end, an applicator edge 14', whereby the carrier tape 5 coming from the reel 10 is led around this edge 14' and back to the cartridge 1. There it is conducted to a windup reel 11, by way of a tension-maintaining spring 6, which is a thin elastically-bendable lever which is rigidly clamped into its base at one end.

The segment of tape which is between the tension-maintaining spring 6 and the windup reel 11, lies against the upper side of the tape which is still on the supply reel 10, which at that point still has an adhesive film on its outer side, by means of which an adhesive effect is produced between the adhesiveless carrier tape going to the windup reel 11 and the supply tape coming off the feed reel 10. This clinging or adhesive effect favors the winding up of the carrier tape 5 coming from the tension-maintaining spring 6 in the direction of the windup reel 11, insofar as a similarly-directed motion is present because as it unwinds, the supply reel 10 turns in the direction of the arrow w (FIG. 2).

On the stiff applicator bar 14 at the end of the support member 12 there is opposite to the applicator edge 14' an attachment in the form of a protrusion (projection) 7 which projects in the direction of the outward motion of the spring.

This protrusion 7 is arranged to be opposite to a solidly-fixed detent 8, which is integral with a mounting receptacle 15 (a post with an aperture) on one of the side plates **2*b* and which serves to attach both side plates 2*a* and 2*b*** of the cartridge to one another.

Further such mounting receptacles 15 protrude, as can be deduced from FIG. 2, from other points of the side plate **2*b*. They are provided with corresponding slightly protruding slip-in pins on the other side plate 2*a*** (not shown in the figures), which can fit into centrally drilled sockets in each mounting receptacle, and snapped in or otherwise anchored.

For better depiction of the reciprocal arrangement of the protrusion 7 and the detent projection 8 in the cartridge, the free space between both projections in FIG. 1 and 2 is shown at the maximally possible spring deflection and not shown to scale but exaggerated to help the clarity of the depiction.

In practice, in an actual cartridge, the maximal spring deflection at the applicator edge 14' is about 1 mm, and consequently the free space f (FIG. **3*a*) between the protrusion 7 and the detent projection 8** is smaller, depending on the lever relationship (for instance, 0.6 or 0.7 mm).

From the depiction in FIG. 2 it can be seen that in the side plate **2*b* a spring guide 16 is provided on the face of the side plate 2*b* facing toward the windup reel 11. This meshes with a toothed wheel (not shown in FIG. 2**) and serves to prevent backlash.

As shown in FIG. 1 and 2, on the face of the side plate **2*a* facing the windup reel there is a radial tooth arrangement 9 which when the cartridge is closed (see FIG. 1) protrudes outward through a matching opening provided in side plate 2*a***, to facilitate the manual retensioning of the windup reel when the cartridge is closed.

For purposes of use, a cartridge 1 of the described type is inserted into a suitably configured housing of a hand roller, in which there is a transmission drive means for driving the windup reel from the supply reel by means of a friction coupling between them. Such drives are known and therefore are not further described here.

This drive has turning bolts (pivot pins) for the windup reel 11 and the feed reel 10, which, when the cartridge is placed in the hand roller housing (not shown), fit into the openings 26 and 27 on the cartridge (corresponding to the interior apertures of the feed reel 10 and the windup reel 11), and thereby, in a suitable way by means of a conformal coupling means, bring about the driving of the reels 10 and 11. In this way, the driving means which is always needed and which is not replaceable, is effectively kept separate from the cartridge and is always in readiness within the hand roller casing.

As is shown in FIG. 2, the point of attachment of the applicator edge 14', the attachment base of 12, and the central axis of the feed reel 10 are arranged on a common line L (at the starting position of the support member 12 and the applicator edge 14', that is, when they are not deflected by spring action from their rest position).

The stiff applicator bar 14 and the support member 12, together with the tension spring 6, can be constructed as a single one-piece unit. The base 13 of the support member 12 is, in this case, linked to the base of the tension spring 6 by a thick part 28, which by suitable means is linked rigidly to the side plate **2*b*** and thus to the cartridge, advantageously for instance by a insert linkage.

In this way, it is possible to rapidly change the entire part, for example in the case where a different application bar is to be used with a different tape. In this instance, a complete replacement of the part by a completely different part with the new application bar can be effected. However, it is equally possible to have the application bar 14 merely stuck onto the end of the support member 12 and after use, removing it and replacing it by mounting a new application bar.

When the cartridge is closed, as shown in FIG. 1, a sight window 3 is located at a suitable place on the side plate **2*a***, in order to display to the user the extent of unwinding of the feed reel and to warn the user when the feed is nearly exhausted.

If the cartridge is to be inserted in a hand roller, there must be a corresponding opening in the housing of the hand roller where the applicator element 4 protrudes in the forward direction of the cartridge.

The roller is now to be held by the user over the substrate onto which the adhesive film or cover film is to be overlaid, and specifically held in such a way that the application bar 14 protruding from the housing is held at an inclined angle against the substrate, as is shown in FIG. **3*a* to 3*e* or in FIG. 4*a* to 4*d***.

By means of the applicator edge 14', the detachment edge 29 (see FIG. **3*a*) of the adhesive film 5*a* which is on the carrier tape 5 (up until the application edge 14'), is pressed on and thus the initial contact between the adhesive film 5*a* and the substrate 17** is brought about, for purposes of the transfer operation.

The user will automatically exert some pressure on the hand roller, by means of which the support member 12, which is held fixed at its base 13 and is not rotatable with respect to the side plate **2*b* of the cartridge 1, is deflected in the manner of a spring to the extent that the top surface of the protrusion 7 encounters the opposing surface of the detent protrusion 8** and is prevented from bending further.

In FIG. **3*a* to 3*e***, the individual steps of this process are once again shown in a diagrammatic way.

FIG. **3*a* shows the end of the support member with the application bar 14, the pressure-applying edge 14', the upper protrusion 7, and the opposing detent 8, with a distance f between them, this being the maximum distance allowed by the spring deflection range of the application bar 14. In this stage, the carrier tape 5 coming from the feed reel up to the pressure-applying edge 14' still has on its side facing the substrate 17 the adhesive film 5a which terminates at the release edge 29**.

Figure 3A:
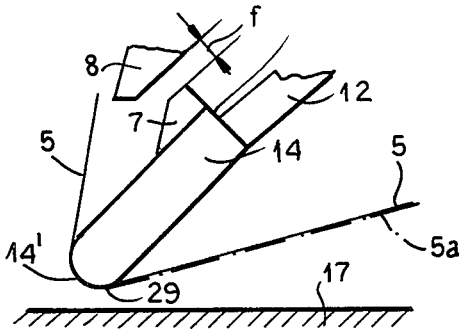
FIG. 3*a* to 3*e* are diagrammatic representations of the setup and operating steps for of the application of a film to a substrate, in accordance with the invention, depicted as a series of consecutive steps.

FIG. 3a shows the situation shortly before setting down the pressure-applying edge 14', whereby here the tape path for the carrier tape 5 exhibits a tensioned tape path.

Figure 3B:
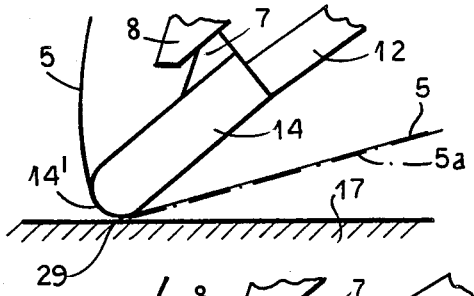

In FIG. 3b is shown the situation at a point in time after the user sets the tool down on the substrate, at which time the application bar 14 already is fully flexed to its furthest spring motion position, and the protrusion 7 has come to a stop at its fixed detent 8.

Figure 3C:
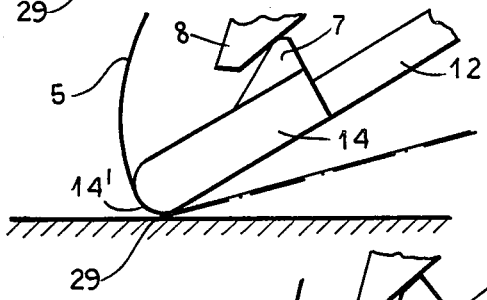

As the result of this spring deflection, the tape 5 behind the application edge 14' is no longer fully tensioned, but somewhat relaxed. If now, as often happens in practice, and as is shown in FIG. 3b, the separation edge 29 of the film 5a at this first seating position is still not directly in contact with the substrate 17, perhaps because in the course of the spring deflection, the pressure edge 14' has slipped forward somewhat on the backside of the carrier tape 5, it is possible to have, as shown in FIG. 3c, a so-called "ironing on" of the release edge 29 against the substrate 17, by virtue of the shifting of the pressure point of the application bar somewhat rearward in the direction of the separation edge 29.

As soon as the "ironing on", that is to say, the meeting up of the separation edge 29 of the adhesive film 5a with the substrate has taken place, from this point on it is only necessary to move the hand roller to traverse the desired length of application onto the substrate 17 under steady pressure.

Figure 3D:
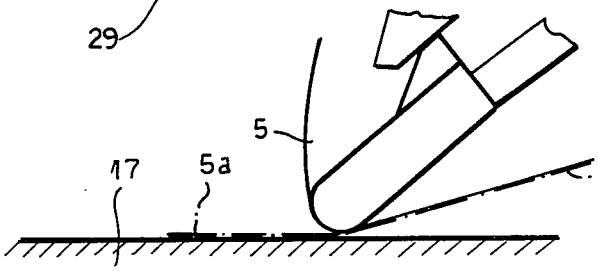

FIG. 3d shows an intermediate point in time in this process. At this point, the film 5a has been fed continuously from the carrier tape 5 for such a length onto the substrate that the desired amount of adhesive has been transferred.

Figure 3E:
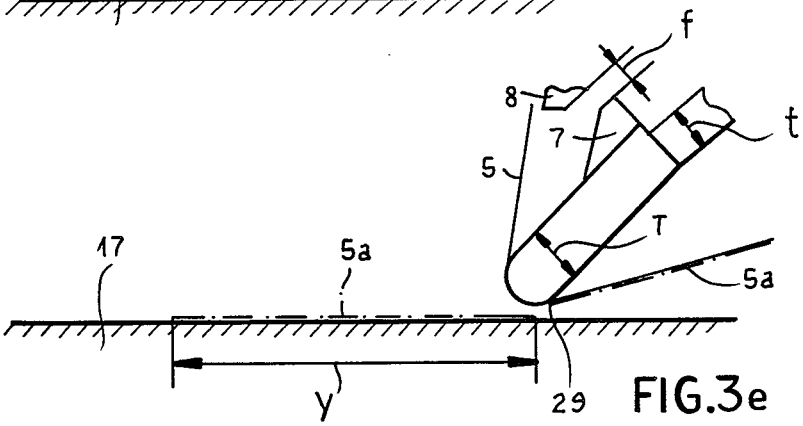

At the end of the transfer, as shown in FIG. 3e, the hand roller is again lifted off, whereby first (not shown in the FIGURE) the support member 12 springs back to its resting position, the protrusion 7 again becomes distanced from its detent 8 and thereby the tape path 5 is once again tensioned. By virtue of the tape tensioning, increased friction is obtained, which leads to a nearly optimal tear off.

If hereafter the roller is raised, the adhesive film 5a is torn off along the new detachment edge 29', and the apparatus is restored to its starting position as in FIG. 3a. On the substrate 17, there is now, as shown in FIG. 3e, the corresponding length of adhesive film 5a applied along the desired length Y.

In FIG. 2 the turning and moving directions during the unwinding and winding up operations at the individual elements are shown by arrows.

In the use of the apparatus, the feed reel 10 turns in the direction of arrow w around its axis A, by which the tape 5 travels in the direction v to the pressure edge 14' and around this then by way of the tension equalizing spring 6 to the windup reel 11, which turns in the direction of the arrow u and thereby winds up the tape 5 which has been released from the film 5a.

As shown in FIG. 3a to 3e, the stiff applicator bar 14 has a thickness T (FIG. 3e) which is substantially greater than the thickness of the spring support member 12 which holds the stiff applicator bar 14. In this connection, it should be pointed out that in the figures, this thickness difference is not shown to exact scale. It is advantageous for the thickness T of the stiff applicator bar to be at least 1.25 times t, the thickness of the support member 12.

FIGS. 4a to 4d show various possibilities for the shaping of the bend at the application edge 14' of the stiff applicator bar 14 (greatly enlarged diagrammatic representations of the detail).

Figure 4A:
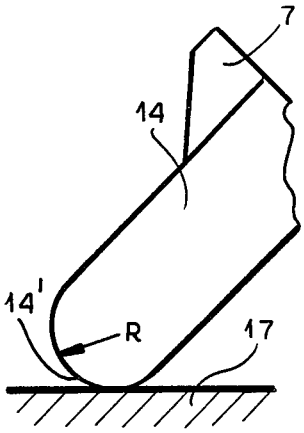
FIG. 4*a* to 4*d* show various different forms for the curvature of the stiff applicator bar at its applicator edge.

In FIG. 4a (as also in FIG. 4b to 4d), a diagrammatic representation is made of a side view of an stiff applicator bar 14 in its use position, diagonally laid against a substrate 17, and having at its rear upper end the protrusion 7. In the embodiment shown in FIG. 4a, the application bar has an pressure-applying edge 14' which in cross section is bounded by a semicircle of constant radius R corresponding to half the thickness T of the stiff applicator bar 14.

Figure 4B:
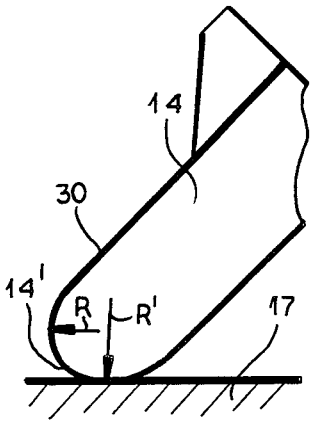

In the embodiment in FIG. 4b, the curvature of the pressure-applying edge 14' is such that, viewed in cross section, starting from the upper side 30 of the stiff applicator bar, there is first a circular form (radius R), extending approximately over a 90 degree angle, which then up to its merging with the lower side of the stiff applicator bar 14 is extended with a boundary of distinctly larger radius R'. In this embodiment, in contrast to that of FIG. 4a, there is achieved a somewhat larger contact region between the pressure-applying edge 14' and the surface of the substrate 17, as can be seen from the FIGURE.

Figure 4C:
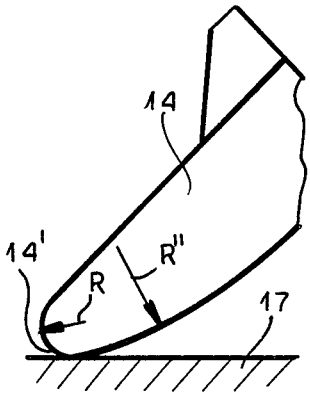

In FIG. 4c, still another cross sectional form is depicted, in which starting from the upper surface of the stiff applicator bar 14, first there is a semicircular curvature of radius R extending over an angular region of 90 degrees or somewhat more, which then continues on with a very much greater radius R'', or optionally the boundary may be an arch of constantly increasing radius. This form is especially suitable to favor the "ironing on" of the release edge of the film being applied, because with this form for the stiff applicator bar 14 even a small decrease in the angular position (perhaps by means of a small increase in the pressure by which the device is applied) brings about an especially distinct rearward shift of the pressure point (that is to say, against the transport direction of the tape 5).

Figure 4D:
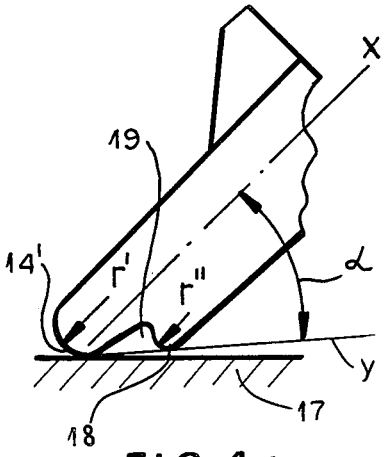

The representation in FIG. 4d shows, finally, a special embodiment of the stiff applicator bar, whereby in the region of the front end of the stiff applicator bar 14, next to a semicircular boundaried pressure-application edge 14' with a relatively small radius r', there is a parallel "heel" edge 18 located at a distance to the rear (that is to say, in the direction counter to the forward direction v of the tape 5). Between the "heel" edge, which also has a semicircular cross section with a very small radius r'', and the pressure-applying edge 14' which lies further along in the direction of the tape motion, there is an indentation 19. Preferably the radius r'' of the "heel" edge is at most half the radius r' of the pressure-applying edge 14'.

Both edges 14' and 18 are arranged relative to one another such that their common tangent y (FIG. 4d) makes an angle of intersection [$\alpha$] with the long axis of the application bar of at least 35 degrees and at most 45 degrees, preferably about 40 degrees, In the normal use position shown in FIG. 4d, only the pressure-applying edge 14' presses the tape against the substrate 17, whereby this accomplishes the continuous transfer of the film 5a from the carrier tape 5 to the substrate 17, as already described.

If, however, at the beginning of the transfer process the detachment edge of the adhesive requires special efforts to get its transfer started, because it does not immediately become taken up from the pressure-applying edge, or because the substrate surface is especially smooth, then it is only necessary with such a design embodiment to make a small decrease in the position angle (designated by Greek letter alpha in the FIGURE) in order that the special edge formed behind the pressure-applying edge 14' by the "heel" edge 18 gets pressed against the substrate 17.

In this way, a sufficient initial contact is achieved so that it is possible by further relative motion between the application bar 14 and the substrate 17 to get the application process to start.

Figure 5:
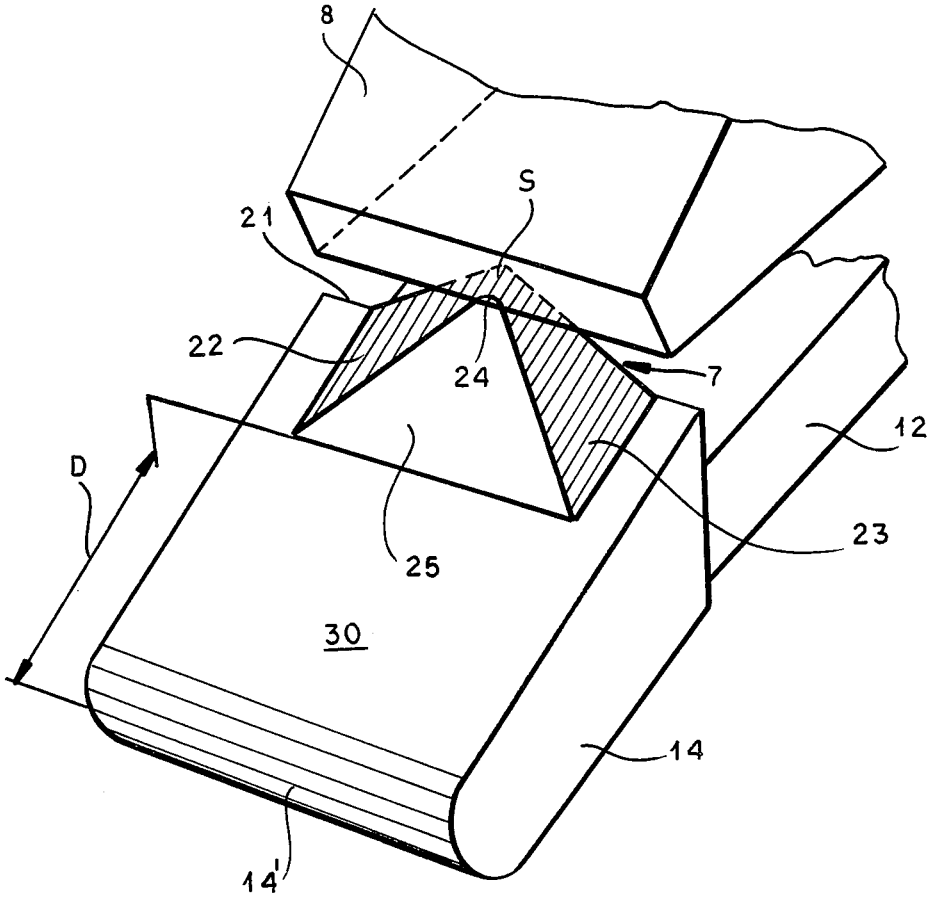
FIG. 5 is a perspective diagram, for purposes of showing the working principle, of the front section of an applicator element in accordance with the invention and of the detent which is fixed in the housing (greatly enlarged representation).

FIG. 5 shows finally a diagrammatic perspective representation of the front end of a support member 12 with the pressure-applying edge 14 attached thereto, on which there is located the protrusion 7, and also represented is a part of the opposing detent 8.

The protrusion 7 is, as clearly shown in FIG. 5, arranged to be somewhat central on the upper surface of the stiff applicator bar 14 and located sufficiently far back (at a distance D from the pressure-applying edge 14' so that at its basal surface it extends up to the back edge 21 of the stiff applicator bar 14. The protrusion 7 has two diagonally upward converging side surfaces 22 and 23 which form a rounded peak 24. At the same time, the front side 25 facing the pressure-applying edge 14' slopes upward from front to back, so that finally the upper rounded end surface S, viewed in the lengthwise direction of the stiff applicator bar, has a much smaller area than the basal area of protrusion 7.

The back surface of the protrusion 7 opposite to the front surface 25 can similarly have a small forward slope, or it may have a surface coplanar with the back surface of the stiff applicator bar. The form of the protrusion 7 can also be such that the rounded terminal surface S is not, as in FIG. 5, of hemicylindrical form but rather, can have the shape of a spherical section.

On maximal deformation of the support member 12 in the direction of the detent 8, the upper terminal surface S of the protrusion 7 comes into immediate contact with the lower side of the detent 8, whereby in the case where the latter is planar, is subjected to a linear movement which merely in the range of the self-elasticity of the material of both protrusions leads to a certain surface distension.

It is highly preferable, however, to have on the under surface of the detent 8, where the impact surface S impinges when the support member 12 is at its maximum deformation, a matching counter-surface, which affords a much-improved rigidity of support, especially where considerable power is applied in the transfer process.

Since in practice, the support member 12 is a very small and thin part, it is possible in the case of an only slightly twisted positioning of the apparatus during the pressing of the tape 14 against a surface, as a result of the elasticity of the support member 12 (which indeed is chosen for its suitability for elastic deformation), to have without any difficulty a compensatory small twist of the support member 12 around its lengthwise axis, to the extent of the angular difference between the apparatus itself and the position of the application bar in contact with the substrate surface.

With the protrusion 7 having the shape shown in FIG. 5, particularly in regard to the detent contact region S, the corresponding twist is acceptable without any difficulty. The pressure exerted by the user on the apparatus is transmitted by way of the detent 8 and the protrusion 7, and with the shape of the protrusion 7 shown in FIG. 5, this pressure can be adequately transmitted between protrusion 7 and detent 8 to the stiff applicator bar 14 even if they are positioned with respect to one another with some angular deformation as the result of the sideways slanting of the apparatus; furthermore, the torsional force exerted on the support member 12 acts as a restoring force when the load is removed.

It will be obvious that the arrangement of the protrusion 7 and the detent 8 could be reversed.

The example given is for purposes of illustration and is not to be construed as limiting.

We claim:

1. A device for the transfer of a film from a carrier tape to a substrate, which comprises:

a housing;

a feed reel for said tape and a windup reel for said tape mounted rotatably in said housing;

mounting means on said housing;

a stiff applicator bar on said mounting means and protruding from said housing and over which said tape passes in going from said feed reel to said windup reel, said stiff applicator bar being configured to press said tape against said substrate with the side of said tape carrying the film against said substrate to effect transfer of said film;

mounting means including an elongated support member connecting said stiff applicator bar to said housing and being elastically deflectable as pressure is exerted on said device, and means for affixing one end of said elongated support member immovably with respect to said housing, an opposite end of said support member bearing said stiff applicator bar, said stiff applicator bar having on a side facing said carrier tape a rounded pressure-applying edge;

a protrusion formed on said stiff applicator bar, located at a distance from said pressure-applying edge; and a detent fixed on said housing located with respect to said protrusion on said stiff applicator bar such that said detent serves to limit the movement of said stiff applicator bar.

2. The device defined in claim 1 where said stiff applicator bar is replaceable.

3. The device defined in claim 2 where said stiff applicator bar is mounted on said support member and held by friction.

4. The device defined in claim 1 where said stiff applicator bar is substantially shorter and thicker than said support member, and where the length of said stiff applicator bar is one-quarter to one-third the length of said support member, and where the thickness of said stiff applicator bar is at least 1.25 that of said support member.

5. The device defined in claim 1 where said stiff applicator bar and said support member are made of different materials.

6. The device defined in claim 1 where said pressure-applying edge of said application bar has decreasing radius of curvature in the direction of motion of the carrier tape.

7. The device defined in claim 1 where said pressure-applying edge has a semicircular cross section of radius equal or less than 1.5 mm.

8. The device defined in claim 6 where the smallest boundary radius of the pressure-applying edge is not larger than 1.5 mm.

9. The device defined in claim 1 where said stiff applicator bar has on its end facing said carrier tape, besides said pressure-applying edge, a parallel rounded heel separated from said pressure-applying edge by an indentation, said heel having a substantially smaller radius than said pressure-applying edge, and where the tangent common to said pressure-applying edge and said heel makes an angle of from 35° to 45° with respect to the long axis of said stiff applicator bar.

10. The device defined in claim 1 where said protrusion on said stiff applicator bar is centrally located on said bar and is hump-shaped.

11. The device defined in claim 1 where said applicator bar and said support member are constructed as a single piece.

12. The device defined in claim 1 where said protrusion is located on said stiff applicator bar at the end away from the end which applies pressure to said carrier tape.

13. The device defined in claim 1 where said protrusion viewed in a direction across and perpendicular to said stiff applicator bar has upwardly converging side surfaces and a rounded peak.

14. The device defined in claim 13 where said protrusion also has its front surface upwardly sloped away from the pressure-applying edge of the stiff applicator bar.

15. The device defined in claim 13 where said protrusion on its upper end facing said detent has a cylindrical or spherical section shape.

16. The device defined in claim 13 where said detent has a matchingly formed surface conforming to said peak of said protrusion.

17. The device defined in claim 1 where said support member is formed as a lever with a knee, where said knee is directed toward said tape and, viewed in a plane perpendicular to the pressure applying edge, the points defined by said pressure-applying edge, the attachment point of said support member, and the axis of said feed reel all lie on a straight line.

18. The device defined by claim 1 where said support, said stiff applicator bar, said support member, said detent and said protrusion all are comprised of plastic.

19. The device defined by claim 1 where said support member is spring metal strip.

20. The device defined by claim 1 where said feed reel and said windup reel and said application bar and support member are constructed in a replaceable cartridge conformed to fit into the housing of a hand tool.

* * * * *